US009970336B2

(12) United States Patent
Gentile et al.

(10) Patent No.: US 9,970,336 B2
(45) Date of Patent: May 15, 2018

(54) INTERNAL-COMBUSTION ENGINE WITH AN ELECTRONICALLY CONTROLLED HYDRAULIC SYSTEM FOR VARIABLE ACTUATION OF THE INTAKE VALVES, PROVIDED WITH A DEVICE FOR REFILLING THE SYSTEM WITH FLUID

(71) Applicant: C.R.F. Societa Consortile per Azioni, Orbassano (Turin) (IT)

(72) Inventors: Luca Gentile, Orbassano (IT); Francesco Vattaneo, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 242 days.

(21) Appl. No.: 14/874,720

(22) Filed: Oct. 5, 2015

(65) Prior Publication Data

US 2016/0169063 A1 Jun. 16, 2016

(30) Foreign Application Priority Data

Dec. 10, 2014 (EP) ..... 14197112

(51) Int. Cl.
*F02D 41/00* (2006.01)
*F01L 9/02* (2006.01)
(Continued)

(52) U.S. Cl.
CPC ..... *F01L 9/025* (2013.01); *F02D 41/061* (2013.01); *F01L 1/3442* (2013.01); *F01L 9/02* (2013.01);
(Continued)

(58) Field of Classification Search
CPC ..... F02D 2041/001; F02D 13/0261; F01L 1/3442; F01L 9/02; F01L 2001/34446; F01L 9/021; F01L 9/025
(Continued)

(56) References Cited

U.S. PATENT DOCUMENTS 5,238,372 A * 8/1993 Morris ..... F01L 25/06 417/393
2005/0155566 A1* 7/2005 Saretto ..... F01L 1/26 123/90.16
(Continued)

FOREIGN PATENT DOCUMENTS

EP 0803642 10/1997
EP 1243761 3/2001
(Continued)

OTHER PUBLICATIONS

Search Report for European Patent Application No. 14197112.7 dated Jun. 22, 2015, 4 pages.

*Primary Examiner* — Jacob Amick
*Assistant Examiner* — Charles Brauch
(74) *Attorney, Agent, or Firm* — RMCK Law Group PLC

(57) ABSTRACT

In an engine having an electronically controlled hydraulic system for variable actuation of intake valves, an operating step of refilling, prior to ignition of the engine, is activated to refill a pressure chamber of the system with fluid when, after prolonged engine inactivity, the chamber has been emptied. In this refilling step, fuel supply to the engine is inhibited, and a camshaft is rotationally driven following upon activation of an engine-starting electrical machine. In this way, a pumping member associated to a tappet for actuating an intake valve is used as a pump for drawing fluid into the pressure chamber from an auxiliary fluid tank. During this step, a control valve is opened and closed in synchronism with movement of the pumping member so as to be open when the pumping member advances towards the pressure chamber and closed when the pumping member moves away from the pressure chamber.

19 Claims, 7 Drawing Sheets

(51) Int. Cl.
*F02D 41/06* (2006.01)
*F01L 1/344* (2006.01)
*F02D 13/02* (2006.01)

(52) U.S. Cl.
CPC ..... *F01L 9/021* (2013.01); *F01L 2001/34446* (2013.01); *F01L 2800/01* (2013.01); *F02D 13/0261* (2013.01); *F02D 2041/001* (2013.01)

(58) Field of Classification Search
USPC ..... 123/2
See application file for complete search history.

(56) References Cited

U.S. PATENT DOCUMENTS

2006/0137634 A1* 6/2006 Vattaneo ..... F01L 9/02 123/90.12
2010/0326384 A1 12/2010 Vatanneo
2011/0054763 A1* 3/2011 Oehlerking ..... F02D 41/0007 701/108
2011/0088644 A1* 4/2011 Nakamura ..... F01L 1/3442 123/90.15
2012/0029796 A1* 2/2012 Chen ..... B60W 30/18018 701/113
2013/0131966 A1* 5/2013 Hirano ..... F02D 17/00 701/112

FOREIGN PATENT DOCUMENTS

EP 1508676 2/2005
EP 1555398 7/2005
EP 1674673 6/2006
EP 1726790 11/2006
EP 1936132 6/2008
EP 2138680 12/2009
EP 2261471 12/2010

* cited by examiner

INTERNAL-COMBUSTION ENGINE WITH AN ELECTRONICALLY CONTROLLED HYDRAULIC SYSTEM FOR VARIABLE ACTUATION OF THE INTAKE VALVES, PROVIDED WITH A DEVICE FOR REFILLING THE SYSTEM WITH FLUID

CROSS REFERENCE TO RELATED APPLICATIONS

This application claims priority to European Patent Application No. 14197112.7 filed on Dec. 10, 2014, the entire disclosure of which is incorporated herein by reference.

FIELD OF THE INVENTION

The present invention relates to internal-combustion engines of the type comprising:

an engine shaft and at least one cylinder that defines a combustion chamber;

at least one intake duct and at least one exhaust duct, which give out into said combustion chamber;

at least one intake valve and at least one exhaust valve, which are associated to said intake and exhaust ducts and are provided with respective return springs that push them towards a closed position;

a camshaft for actuating said at least one intake valve, by means of a respective tappet, said camshaft being driven in rotation by the engine shaft;

wherein said at least one intake valve is controlled, against the action of the aforesaid return spring, by the respective tappet by interposition of hydraulic means including a pressure chamber facing which is a pumping plunger connected to the tappet, said pressure chamber being adapted to communicate with the chamber of a hydraulic actuator associated to said at least one intake valve;

an electrically actuated control valve, associated to said at least one intake valve of each cylinder and adapted to set said pressure chamber in communication with an exhaust volume in order to decouple said at least one intake valve from the respective tappet and cause fast closing of said at least one intake valve as a result of the respective return spring;

electronic control means, for controlling said electrically actuated valve so as to vary the instant of opening and/or the instant of closing and the lift of said at least one intake valve as a function of one or more operating parameters of the engine; and electrically actuated fuel-injector means, controlled by said electronic control means for supplying fuel into said combustion chamber, there being associated to said engine an electrical machine for engine cranking adapted to activate rotation of the engine shaft in a step of starting of the engine.

An engine of the above type is described, for example, in any one of the documents EP 0 803 642 B1, EP 1 555 398, EP 1 508 676 B1, EP 1 674 673 B1 and EP 2 261 471 A1, all filed in the name of the present applicant.

PRIOR ART

Since long the present applicant has been developing internal-combustion engines comprising a system for variable actuation of the intake valves of the type indicated above, marketed under the trademark "MULTIAIR". The present applicant is the holder of numerous patents and patent applications regarding engines provided with a system of the type specified above.

FIG. 1 of the annexed drawings shows a cross-sectional view of an engine provided with the "MULTIAIR" system, as described in the European patent No. EP 0 803 642 B1.

With reference to FIG. 1, the engine illustrated therein is a multicylinder engine, for example an inline-four-cylinder engine, comprising a cylinder head 1. The cylinder head 1 comprises, for each cylinder, a cavity 2 formed by the base surface 3 of the cylinder head 1, which define the combustion chamber CO and giving out into which are two intake ducts 4, 5 and two exhaust ducts 6. Communication of the two intake ducts 4, 5 with the combustion chamber 2 is controlled by two intake valves 7, of the traditional poppet type, each comprising a stem 8 slidably mounted in the body of the cylinder head 1.

Each valve 7 is recalled into the closing position by springs 9 set between an internal surface of the cylinder head 1 and an end valve retainer 10. Communication of the two exhaust ducts 6 with the combustion chamber is controlled by two valves 70, which are also of a traditional type and associated to which are springs 9 for return towards the closed position.

Opening of each intake valve 7 is controlled, in the way that will be described in what follows, by a camshaft 11, which is rotatably mounted about an axis 12 within supports of the cylinder head 1 and comprises a plurality of cams 14 for actuation of the intake valves 7.

Each cam 14 that controls an intake valve 7 co-operates with the plate 15 of a tappet 16 slidably mounted along an axis 17, which, in the case of the example illustrated in the prior document cited, is set substantially at 90° with respect to the axis of the valve 7. The plate 15 is recalled against the cam 14 by a spring associated thereto. The tappet 16 constitutes a pumping plunger slidably mounted within a bushing 18 carried by a body 19 of a pre-assembled unit 20, which incorporates all the electrical and hydraulic devices associated to actuation of the intake valves, according to what is described in detail in what follows.

The pumping plunger 16 is able to transmit a thrust to the stem 8 of the valve 7 so as to cause opening of the latter against the action of the elastic means 9, by means of pressurized fluid (preferably oil coming from the engine-lubrication circuit) present in a pressure chamber C facing which is the pumping plunger 16, and by means of a plunger 21 slidably mounted in a cylindrical body constituted by a bushing 22, which is also carried by the body 19 of the subassembly 20.

Once again in the known solution illustrated in FIG. 1, the pressurized-fluid chamber C associated to each intake valve 7 can be set in communication with an exhaust volume including a channel 23, via an electrically actuated control valve 24, for example a solenoid valve. The solenoid valve 24, which may be of any known type, suitable for the function illustrated herein, is controlled by electronic control means, designated as a whole by 25, as a function of signals S indicating operating parameters of the engine, such as the position of the accelerator and the engine r.p.m. In the specific case illustrated herein, the valve 24 is normally open and can be closed by supplying electrical current to its solenoid.

When the solenoid valve 24 is open, the chamber C enters into communication with the channel 23 so that the pressurized fluid present in the chamber C flows into said channel, and a decoupling is obtained of the cam 14 and of the respective tappet 16 from the intake valve 7, which thus returns rapidly into its closing position under the action of the return springs 9. By controlling the communication between the chamber C and the exhaust channel 23, it is consequently possible to vary as desired the time and stroke of opening of each intake valve 7.

The exhaust channels 23 of the various solenoid valves 24 all give out into one and the same longitudinal channel 26 communicating with pressure accumulators 27, only one of which is visible in FIG. 1.

All the tappets 16 with the associated bushings 18, the plungers 21 with the associated bushings 22, the solenoid valves 24 and the corresponding channels 23, 26 are carried by and obtained from the aforesaid body 19 of the pre-assembled unit 20, to the advantage of rapidity and ease of assembly of the engine. This unit can also be divided into separate sub-blocks, each sub-block being associated to a respective cylinder.

The exhaust valves 70 associated to each cylinder are controlled, in the embodiment illustrated in FIG. 1, in a traditional way, by a respective camshaft 28, via respective tappets 29, even though in principle there is not excluded, in the case of the prior document cited, an application of the hydraulic-actuation system also to the control of the exhaust valves.

Once again with reference to FIG. 1, the variable-volume chamber defined inside the bushing 22 and facing the plunger 21 (which in FIG. 1 is illustrated in its condition of minimum volume, given that the plunger 21 is in its top end-of-travel position) communicates with the pressurized-fluid chamber C via an opening 30 made in an end wall of the bushing 22. This opening 30 is engaged by an end nose 31 of the plunger 21 in such a way as to provide hydraulic braking of the movement of the valve 7 in the closing stage, when the valve is close to the closing position, in so far as the oil present in the variable-volume chamber is forced to flow into the pressurized-fluid chamber C passing through the clearance existing between the end nose 31 and the wall of the opening 30 engaged thereby. In addition to the communication constituted by the opening 30, the pressurized-fluid chamber C and the variable-volume chamber of the plunger 21 communicate with one another via internal passages made in the body of the plunger 21 and controlled by a non-return valve 32, which enables passage of fluid only from the pressurized chamber C to the variable-volume chamber of the plunger 21.

During normal operation of the known engine illustrated in FIG. 1, when the solenoid valve 24 excludes communication of the pressurized-fluid chamber C with the exhaust channel 23, the oil present in this chamber transmits the movement of the pumping plunger 16, imparted by the cam 14, to the plunger 21 that governs opening of the valve 7. In the initial step of the movement of opening of the valve, the fluid coming from the chamber C reaches the variable-volume chamber of the plunger 21 passing through the non-return valve 32 and further passages that set the internal cavity of the plunger 21, which has a tubular conformation, in communication with the variable-volume chamber. After a first displacement of the plunger 21, the nose 31 exists from the opening 30 so that the fluid coming from the chamber C can pass directly into the variable-volume chamber through the opening 30, which is now free.

In the reverse movement of closing of the valve, as has already been said, during the final step the nose 31 enters the opening 30 causing hydraulic braking of the valve so as to prevent impact of the body of the valve against its seat, for example following upon an opening of the solenoid valve 24, which causes immediate return of the valve 7 into the closing position.

In the system described, when the solenoid valve 24 is closed, the intake valve 7 of the engine follows the movement of the cam (full lift). An anticipated closing of the intake valve 7 can be obtained by deactivating (opening) the solenoid valve 24 so as to empty out the chamber C and obtain closing of the intake valve 7 of the engine under the action of the respective return springs 9. Likewise, a delayed opening of the valve can be obtained by delaying activation of the solenoid valve, whereas the combination of a delayed opening and an anticipated closing of the valve can be obtained by closing and opening of the solenoid valve during the thrust of the corresponding cam.

According to an alternative strategy, in line with the teachings of the patent application No. EP 1 726 790 A1 filed in the name of the present applicant, each intake valve can be controlled in "multi-lift" mode, i.e., according to two or more repeated "subcycles" of opening and closing. In each subcycle, the intake valve opens and then closes completely within one and the same actuation by the cam. The electronic control unit is consequently able to obtain a variation of the instant of opening and/or of the instant of closing and/or of the lift of the intake valve, as a function of one or more operating parameters of the engine, such as r.p.m., temperature and/or viscosity of the fluid used in the system and/or other engine operating parameters. This enables the maximum engine efficiency to be obtained, and the lowest fuel consumption, in every operating condition.

FIG. 2 of the annexed drawings corresponds to FIG. 6 of EP 1 674 673 and shows the scheme of the system for actuation of the two intake valves associated to each cylinder, in a conventional MULTIAIR system. This figure shows two intake valves 7 associated to one and the same cylinder of an internal-combustion engine, which are controlled by a single pumping plunger 16, which is in turn controlled by a single cam of the engine camshaft (not illustrated) acting against its plate 15. FIG. 2 does not illustrate the return springs 9 (see FIG. 1), which are associated to the valves 7 and tend to bring them back into the respective closing positions, and does not illustrate either the spring that recalls the plate 15 against the cam.

As may be seen, in the conventional system of FIG. 2, a single pumping plunger 16 controls the two valves 7 via a single pressure chamber C, communication of which with the exhaust is controlled by a single solenoid valve 24 and which is in hydraulic communication with both of the variable-volume chambers C1, C2 facing the plungers 21 for control of the two valves. The system of FIG. 2 is able to operate in an efficient and reliable way above all in the case where the volumes of the hydraulic chambers are relatively small. This possibility is afforded by the adoption of hydraulic tappets 400 on the outside of the bushings 22, according to what has already been illustrated in detail for example in the document No. EP 1 674 673 B1 filed in the name of the present applicant. In this way, the bushings 22 can have an internal diameter that can be chosen as small as desired.

For the valve 24 there may be envisaged, instead of the solenoid actuator, any other type of electrically operated actuator, for example a piezoelectric actuator or an actuator of a magnetostrictive type. Preferred embodiments of valves of this type have formed the subject of the European patent application No. EP 13 168 666.9 filed in the name of the present applicant on May 22, 2013.

The solution illustrated in FIG. 2 affords obvious advantages from the standpoint of simplicity and economy of production, and from the standpoint of reduction of the overall dimensions, as compared to the solution illustrated, for example, in the document No. EP 0 803 642 B1, which envisages two solenoid valves for controlling separately the two intake valves of each cylinder. Also the latter solution, however could be applied in the engine forming the subject of the present invention.

FIG. 3 of the annexed drawings shows a diagram of the electronically controlled hydraulic system for variable actuation of the engine intake valves, obtained in conformance with the conventional MULTIAIR system. In this figure, parts that are in common with or correspond to those of FIG. 1 are designated by the same reference numbers.

FIG. 3 illustrates by way of example a variant in which each cam 14 controls the respective tappet 15 via a rocker arm 150, which is supported in a way articulated around an end thereof about an axis 151 on a support 151*a* fixed to the structure of the engine and has its opposite end carrying a freely rotatable roller 153, which co-operates with the tappet 15. The central portion of the rocker arm 150 carries a freely rotatable roller 152, which co-operates with the cam 14. A spring 154 recalls the tappet 15 into contact with the roller 153 of the rocker arm 150.

The pressure chamber C that the pumping plunger 16 faces communicates via two passages d1, d2 with the hydraulic chambers of the two actuators 21 that actuate the two intake valves 7 associated to each engine cylinder. The pressure chamber C moreover communicates with a passage d3 that can be connected to the channel 23 via the solenoid valve 24, which is controlled by the electronic control unit 25.

In the resting condition, the solenoid valve 24 is in an open condition and the pressure chamber C is in communication with the exhaust volume defined by the channel 23. The electronic control unit 25 can control supply of electrical current to the solenoid of the solenoid valve 24 so as to cause closing of said solenoid valve in such a way as to isolate the pressure chamber C from the exhaust volume. The portion of the channel 23 that defines the exhaust volume is isolated by means of a non-return valve 400 with respect to a channel 230, which is connected to a supply pump 900 in such a way that the fluid contained in the aforesaid exhaust volume defined by the channel 23, comprised between the valve 400 and the solenoid valve 24, cannot flow into the channel 230, whereas any possible flow of fluid supplied by the pump 900 can enter the channel 23.

In the specific case of the example considered herein, the fluid used is the oil for lubrication of the engine, and the pump 900 is the pump of the circuit for lubrication of the engine, which is activated by the engine shaft when the engine is active.

The diagram of FIG. 3 shows also the hydraulic accumulator 270 that communicates with the exhaust volume defined by the channel 23, constituted by a cylinder with a piston 271 recalled by a spring 272. The piston 271 faces a chamber 273 communicating with the exhaust channel 23.

During normal operation of the system, when the solenoid valve 24 is open, the fluid coming from the pressure chamber C is discharged into the channel 23 and fills the chamber 273 of the accumulator 270, causing recession of the piston 271, against the action of the spring 272.

Once again according to the known art, the channel 23 is also in communication with a fluid tank 300 closed at the top by a lid provided with at least one opening 301 for venting to the atmosphere. The tank 300 guarantees an additional capacity of fluid that makes up for any possible leakage of fluid from the pressure chamber during normal operation of the engine. Such leakage may, for example, occur at the actuators 21 of the intake valves 7 between the plungers of these actuators and the cylindrical wall within which the plungers slide. Leakage of fluid may also occur at the pumping plunger 16, between the wall of the pumping plunger and the wall of the cylindrical body within which the pumping plunger 16 is slidably mounted.

The channel 230 upstream of the channel 23 is in communication with a delivery duct 800 of the pump 900. The pump can draw fluid from a tank 801, which in the specific case illustrated is the tank of the oil for engine lubrication. In the case of a multicylinder engine, the line 800 is a line common to all the cylinders of the engine, whereas the portion of the system illustrated in FIG. 3 that is downstream of the channel 230 is repeated for each of the cylinders of the engine.

Provided in the supply line 800 is a further tank 500 that is closed at the top by a lid provided with at least one opening 501 for venting to the atmosphere. The channel 230 extends starting from an outlet 502 formed on the bottom of the tank 500. The duct 800 is connected to an inlet 503 located in the top part of the tank 500. Arrangement of the inlet 503 in the top part and of the outlet 502 in the bottom part of the tank 500 guarantees that may possible amount of air contained in the flow of fluid coming from the supply pump 900 gathers in the top part of the tank 500 and then exits into the atmosphere through the vent 501. A non-return valve 802 is set in the line 800 for enabling passage of fluid only in the direction that goes from the pump 900 to the tank 500.

FIG. 4 is a further diagram that shows operation of the known system described above. In this diagram, the solid lines show the theoretical profile of lift of each intake valve 7 corresponding to the profile of the cam 14 that controls the intake valve. The example illustrated regards a version of the MULTIAIR system forming the subject of the patent EP 1 936 132 B1 filed in the name of the present applicant. In this version, the cam 14 has a lobe shaped in such a way as to determine a theoretical profile of lift A with an additional initial portion A1 that starts already during the exhaust phase of the cylinder, during rise of the piston towards the top dead centre (TDC) so as to obtain an opening of the intake valve already during the exhaust phase that precedes the engine intake phase, where the piston moves from top dead centre (TDC) to bottom dead centre (BDC). Of course, this solution is here illustrated purely by way of example, given that the invention can be applied to any cam conformation.

In the case where the solenoid valve 24 is kept always closed, the intake valves 7 are controlled with a profile of lift exactly corresponding to the profile illustrated in FIG. 4, which is determined by the profile of the cam 14.

The dashed line in FIG. 4 shows the signal of the electrical current supplied to the solenoid of the solenoid valve 24. In the case of the example illustrated, the solenoid valve 24 is normally open and closes when its solenoid is supplied with electric current. With reference to FIG. 4, illustrated therein is a mode of operation of the MULTIAIR system in which the solenoid of the solenoid valve 24 receives an electric current that brings about closing of the solenoid valve 24 at an instant $t_0$ prior to TDC, but subsequent to the engine angle where the cam would start to bring about lift A1 of the intake valve 7. At the instant $t_0$ the electric current passes from a zero value to a peak value, necessary to obtain movement of the mobile member of the solenoid valve, which is then followed by a step in which the current is kept at a lower but non-zero value, sufficient for keeping the mobile member of the solenoid valve in the closed condition. At an instant $t_1$ the current for supplying the solenoid goes back to zero. In the case of this example of mode of control of the solenoid valve 24, each intake valve 7 will start to open only immediately after the instant $t_0$ and will close again after the instant $t_1$. Of course, the mode described here is shown only by way of example. As illustrated above, the times of opening and closing of the solenoid valve 24 are varied as a function of the operating parameters of the engine (such as engine r.p.m., engine load, oil temperature, and any further parameter indicating the operating conditions of the engine) in order to achieve the desired results in terms of greater engine efficiency, lower consumption, and reduction of noxious exhaust emissions.

Technical Problem

With reference to the known system illustrated in FIG. 3, the supplementary tanks 300 and 500 constitute a reserve of fluid that guarantees that the pressure chamber C associated to each cylinder of the engine is always able to operate, even in the case where leakage of fluid from the system is present. As already mentioned, minor leakage of fluid may occur at the pumping plunger 16 and at the actuators 21, in the passages defined between each plunger and the cylindrical wall within which the plunger slides. However, leakage could in theory become detrimental for proper operation of the system in the case where the engine were to remain inactive for a prolonged time (at least in the region of a few months). As mentioned above, the solenoid valve 24 associated to each cylinder is normally open and the pump 900 is not active when the engine is not active. Following upon of a long period of inactivity of the engine there may consequently occur complete emptying of the hydraulic system associated to each cylinder, in the part downstream of the respective non-return valve 400, for example on account of a continuous leakage of fluid at the actuators 21 (which in the concrete embodiment are located in the lowest point of the system). In the case where such a hypothetical situation were to arise, it might not be any longer possible to start the engine, since the intake valves 7 of the cylinder that has undergone the aforesaid leakage of fluid would remain constantly closed and would not be able to "perceive" the actuation cam 14.

Object of the Invention

The object of the present invention is to solve the technical problem referred to above.

A further object of the invention is to achieve the above aim with simple and low-cost means.

A further object is to provide means adapted to intervene automatically for refilling with fluid the hydraulic system in an automatic way at engine cranking, whenever the need arises.

SUMMARY OF THE INVENTION

With a view to achieving one or more of the aforesaid purposes, the subject of the invention is an internal-combustion engine having all the characteristics indicated at the start of the present description and moreover characterized in that:

said pressure chamber is in communication with an auxiliary fluid tank via a non-return valve that enables passage of fluid exclusively from said auxiliary tank in the direction of the pressure chamber, said auxiliary tank not having any direct communication with said exhaust volume; and said electronic control means are programmed for activating an operating step prior to ignition of the engine for refilling the pressure chamber, in which the following operations are carried out:

a) supply of fuel to said combustion chamber is inhibited;

b) said electrical machine is activated for setting in rotation the engine shaft and consequently said camshaft so that a reciprocating motion of said pumping plunger is activated;

c) said electrically actuated control valve is cyclically opened and closed, in synchronism with the movement of said pumping plunger, in such a way that said control valve is open in the step where the pumping plunger advances towards the pressure chamber and is closed in the step where the pumping plunger moves away from said pressure chamber so that the pumping plunger functions as suction pump for recalling fluid from said auxiliary tank to the pressure chamber; and d) after a time interval, supply of fuel to said combustion chamber is enabled and the electrically actuated control valve is kept closed to obtain actuation of the intake valves and ignition of the engine.

According to a first embodiment, the aforesaid time interval is a fixed and predetermined time interval, after which the system prepares for ignition of the engine.

In a variant of this first embodiment, the above time interval corresponds to a predetermined number of cycles of forward and backward movements of the pumping plunger.

In a second embodiment, in which the engine comprises a pressure sensor adapted to detect the pressure in the pressure chamber and to issue a signal that is received by the electronic control means, the above time interval corresponds to the time necessary for the pressure sensor to warn that a predetermined value of the pressure in the pressure chamber has been exceeded.

Thanks to the aforesaid characteristics, the system according to the invention is able to refill the pressure chamber with fluid in the case it has been emptied following upon a prolonged inactivity of the engine.

According to a further preferred characteristic, sensor means are provided adapted to detect movement of the aforesaid at least one intake valve, and the aforesaid electronic control means are programmed for activating the aforesaid operating step prior to ignition of the engine when in the step of engine cranking an absence of movement of the aforesaid at least one intake valve is detected.

According to a first solution of the above embodiment, the sensor means adapted to detect movement of the at least one intake valve comprise a pressure sensor for detecting the pressure in the intake manifold of the engine, which is adapted to issue a signal that is received by said electronic control means.

In a variant, the aforesaid sensor means comprise an accelerometer associated to said at least one intake valve, the signal of which is received by said electronic control means.

In the embodiment where a pressure sensor is provided adapted to detect the pressure in the pressure chamber and to issue a signal that is received by the electronic control means, the latter are programmed for activating the aforesaid operating refilling step prior to engine ignition when in the step of engine cranking a pressure in the pressure chamber is detected lower than a predetermined threshold value.

According to a further preferred characteristic, the aforesaid auxiliary fluid tank is connected to said pressure chamber by means of a connection duct having a first end communicating with the pressure chamber on a downstream side of the control valve, opposite to the side of the exhaust volume, and a second end connected to the auxiliary tank in the part bottom of the tank itself, this second end being located at a level lower than that of the first end.

Thanks to the above characteristic, the presence of a predetermined amount of fluid in the aforesaid auxiliary tank is guaranteed, even after a prolonged inactivity of the engine, in so far as the fluid present in the auxiliary tank is unable to flow away towards the pressure chamber.

The subject of present invention is also the method for controlling the system described above.

DESCRIPTION OF A PREFERRED EMBODIMENT

Further characteristics and advantages of the invention will emerge from the ensuing description with reference to the annexed drawings, which are provided purely by way of non-limiting example and in which:

FIG. 1, already described above, illustrates in a cross-sectional view the cylinder head of an internal-combustion engine provided with a MULTIAIR system for variable actuation of the intake valves, according to what is illustrated in the document No. EP 0 803 642 B1;

FIG. 2, which has also already been described above, illustrates the control system of two intake valves associated to one and the same cylinder of the engine, in a MULTIAIR system of the conventional type described, for example, in EP 2 261 471 A1;

FIG. 3, which has also already been described above, illustrates a diagram of the hydraulic system according to the known art;

FIG. 4, which has also already been described above, illustrates the diagrams of lift of the intake valves and a mode of control of the electrical valve of the system according to the known art;

FIGS. 1-4 have already been described above. With reference to FIG. 5, the parts in common with those of FIG. 3 are here designated by the same reference numbers.

Figure 1:
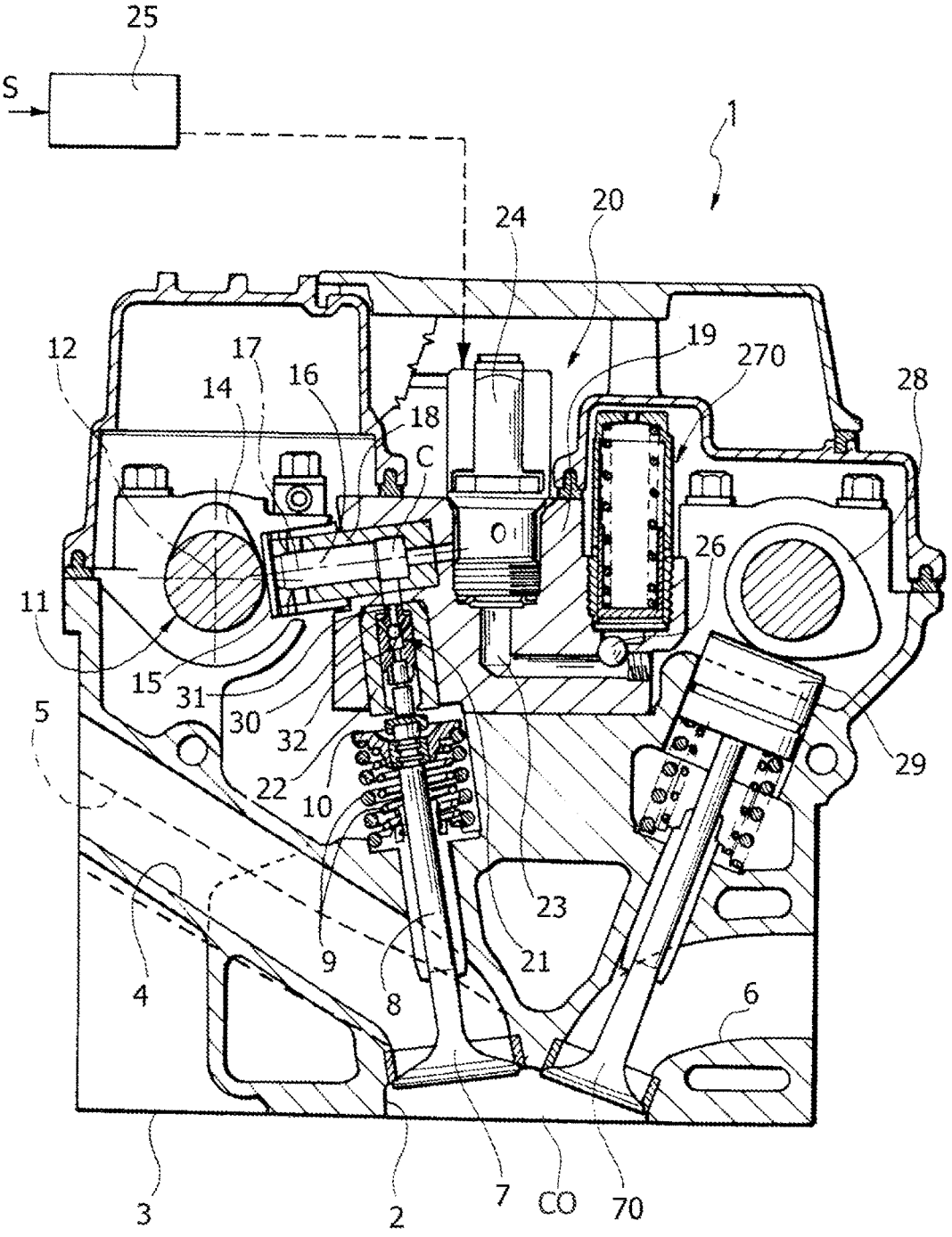
Figure 2:
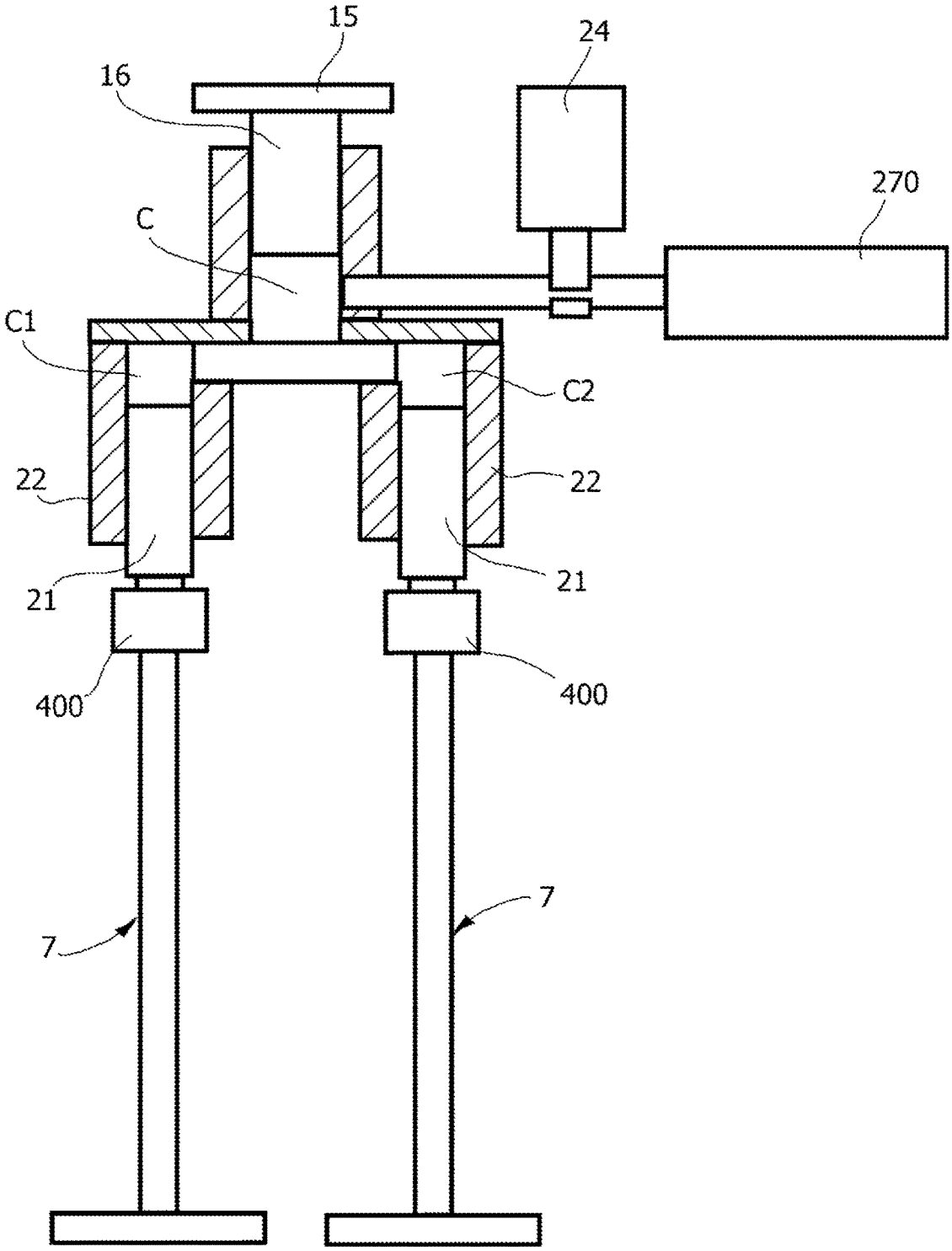
Figure 3:
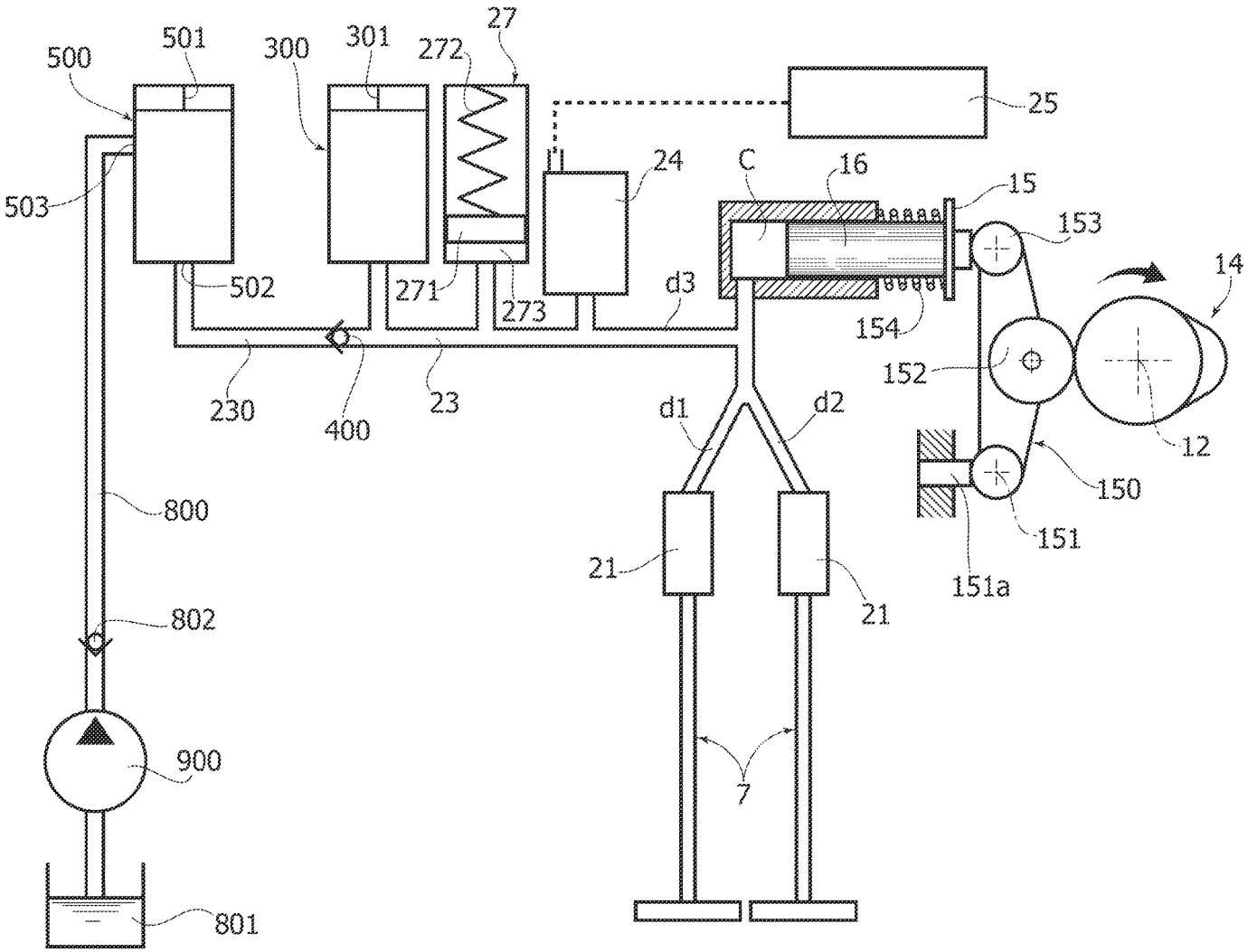
Figure 4:
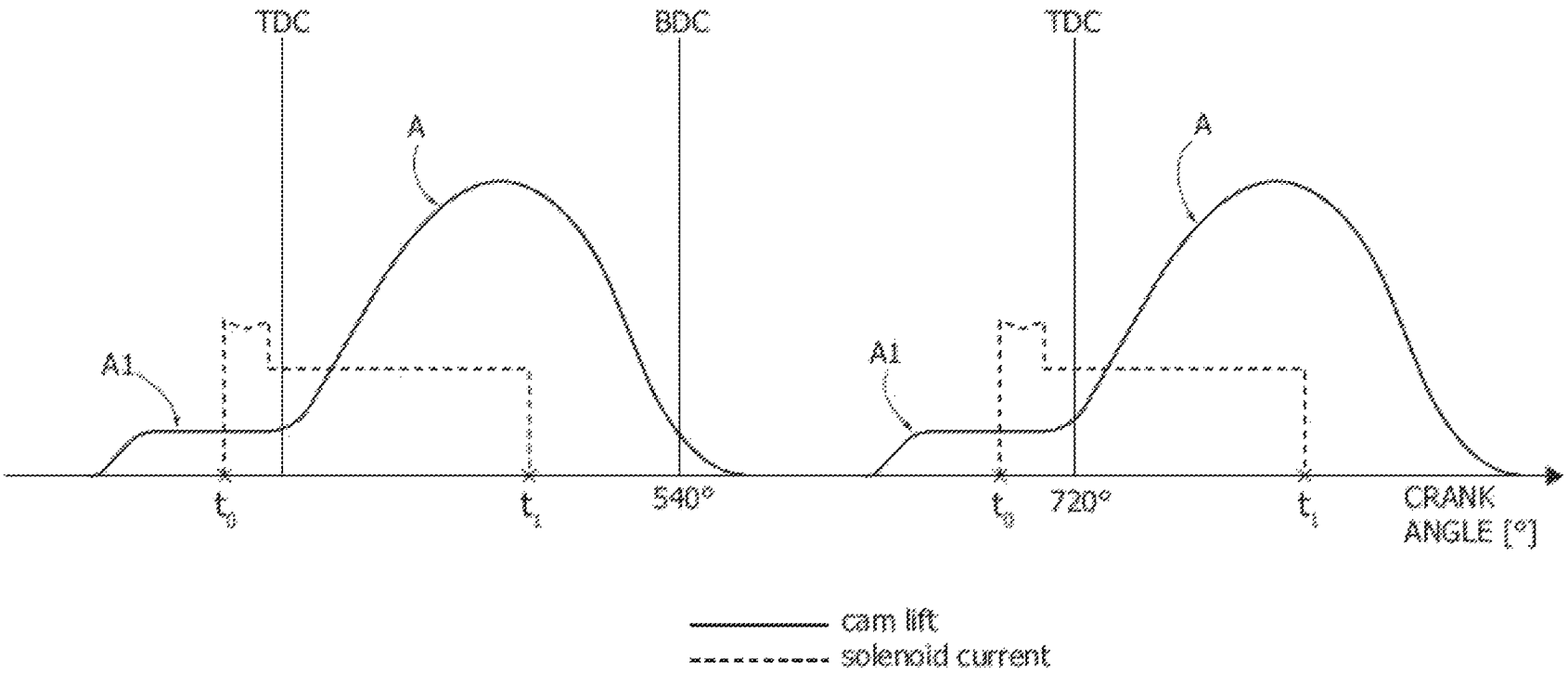

A first characteristic of the system according to the invention lies in the fact that it comprises an auxiliary fluid tank 600 that is not in communication with the exhaust channel 23 upstream of the solenoid valve 24. The auxiliary tank 600 is filled with fluid during normal operation of the engine, in so far as it has an inlet 601 connected to a branch 803 of the delivery duct 800 of the pump 900. The inlet 601 is set in the top part of the aforesaid tank, which is closed at the top by a lid having at least one opening 602 for venting into the atmosphere.

The auxiliary tank 600 has an outlet, adjacent to its bottom, connected to one end 603 of a duct 604, the opposite end 605 of which communicates with the pressure chamber C, downstream of the channel 23 and of the solenoid valve 24. In the example illustrated, the duct 604 gives out into the duct d3. Set in the connection duct 604 is a non-return valve 700 that enables passage of fluid only in the direction that goes from the tank 600 to the duct d3.

In the normal condition of use of the engine, the end 603 of the connection duct 604 is at a level lower than the end 605 connected to the pressure chamber. Furthermore, this end 603 occupies a lower position than the two areas of possible leakage of oil, which are represented by the area of the pumping plunger 16 and by the lowest areas of the actuators 21. Consequently, such areas of possible leakage of oil are, respectively, at a height H1 and at a height H2, with H1>0 and H2>0, with respect to the outlet of the auxiliary tank (see FIG. 5). Consequently, even in the case of a very long period of inactivity of the engine, and even in the case where the hydraulic system downstream of the non-return valve 400 empties completely on account of leakage of fluid through the actuators 21, the tank 600 continues to be full of fluid. The purpose of this tank is in fact to ensure always and in any case an additional fluid capacity, even following upon long periods of inactivity of the engine.

The electronic control unit 25 is programmed for activating an operating step of refilling of the hydraulic system prior to ignition of the engine. According to this operating mode, the electronic control unit 25 inhibits supply of fuel to the cylinders of the engine, while the step of engine cranking is activated.

Figure 6A:
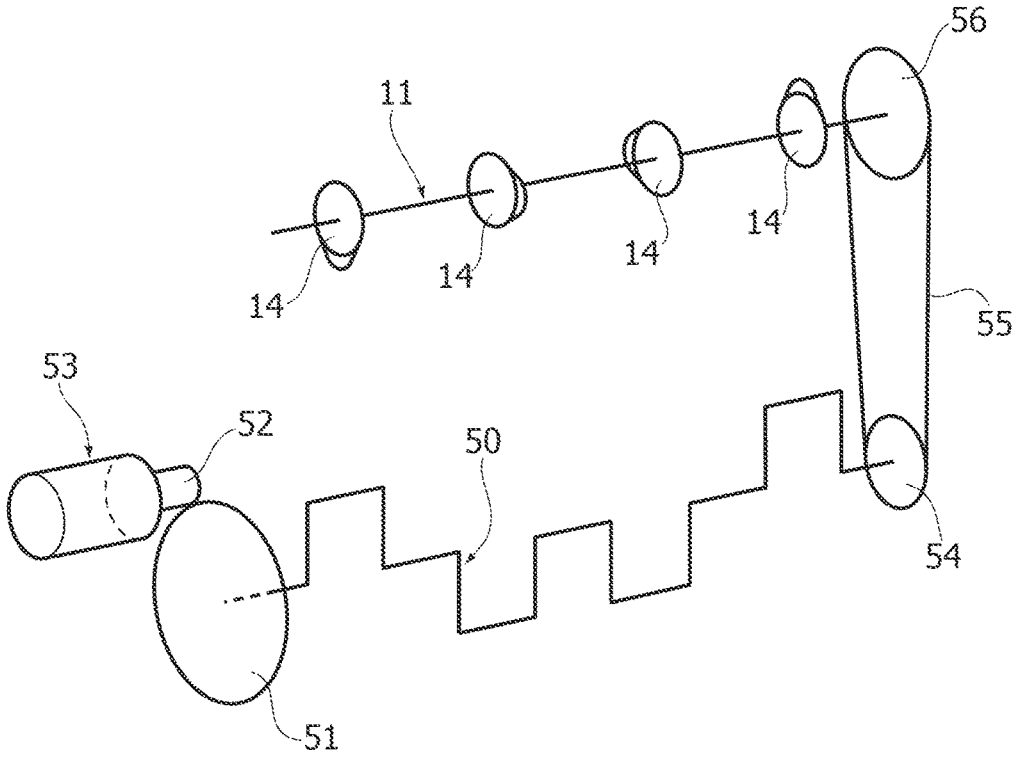
FIGS. 6A and 6B are diagrams of an internal-combustion engine applied to which is the system according to the invention.

FIG. 6A of the annexed drawings is a schematic illustration of the usual arrangement of an internal-combustion engine with an engine shaft 50 having one end carrying a flywheel 51 bearing a ring gear that can be engaged by a pinion 52 carried by the shaft of an electrical machine 53 pre-arranged for engine cranking. The opposite end of the engine shaft 50 carries a pulley or gear 54 that drives in rotation, by means of a cogged-belt or chain transmission 55, a pulley or gear 56 mounted on an end of the camshaft 11. Consequently, during engine cranking, when the electrical machine 53 is activated, the engine shaft 50 is set in rotation and transmits a rotation (with transmission ratio 1:2) to the camshaft 11.

Figure 6B:
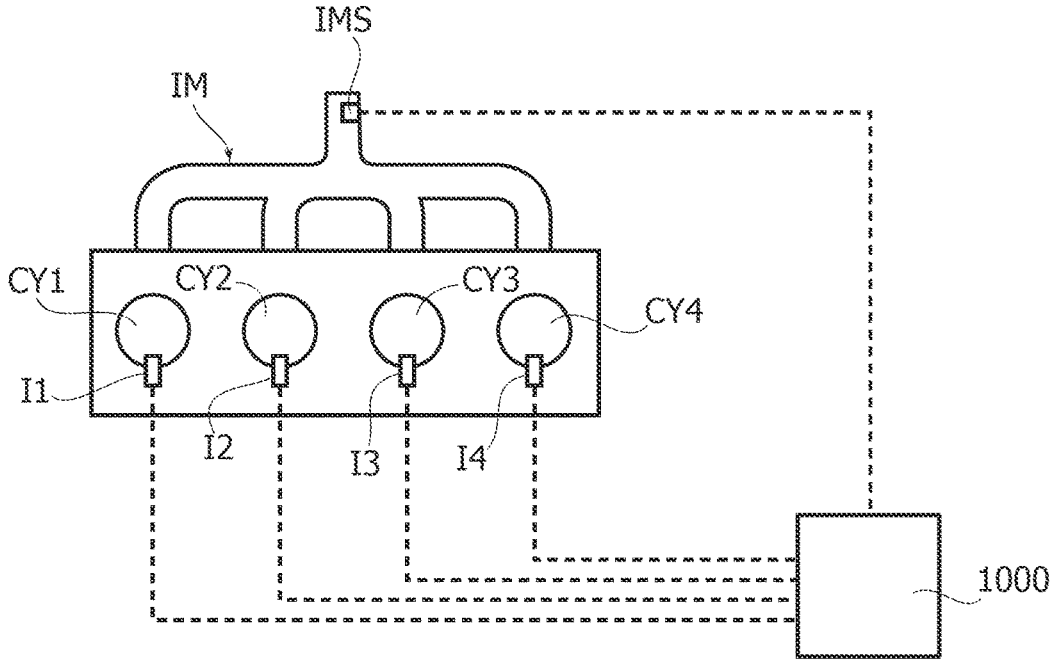

FIG. 6B of the annexed drawings is a schematic illustration of an internal-combustion engine with four cylinders CY1, CY2, CY3, CY4 that receive air from an intake manifold IM and fuel from injectors I1, I2, I3, I4 electronically controlled by a control unit 1000 (which may coincide with the control unit 25 already described above).

According to the invention, in the aforesaid refilling step prior to ignition of the engine, the electronic control unit 1000 inhibits supply of fuel to the engine so that the engine remains off. Each cam 14 of the camshaft is instead set in rotation, in so far as the camshaft is turned, as already referred to above, by the electrical starting machine 53.

Figure 5:
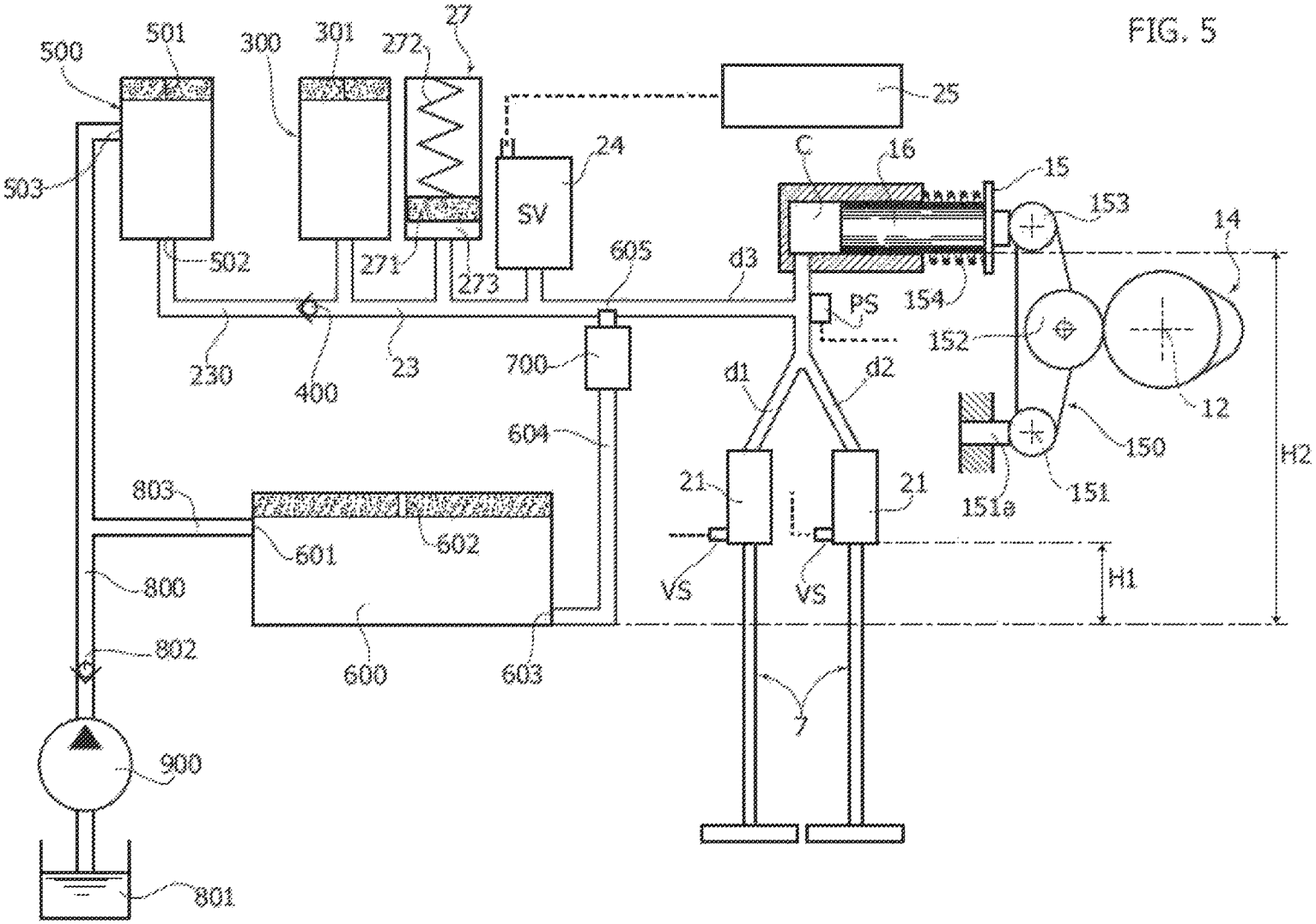
FIG. 5 illustrates a diagram similar to that of FIG. 3, but modified according to the teachings of the present invention.

With reference to FIG. 5, during the aforesaid refilling step prior to ignition of the engine, the rotation of the cam 14 determined by the electrical starting machine 53 causes a reciprocating motion of the pumping plunger 16, which cannot, however, bring about a movement of the intake valves 7 in so far as the pressure chamber C is empty.

Once again in said refilling operating mode prior to the step of ignition of the engine, the electronic control unit 25 is programmed for controlling the solenoid valve 24 in such a way as to open it and close it cyclically in synchronism with the movement of the pumping plunger 16 caused by the cam 14. More precisely, in this refilling operating step, the solenoid valve 24 is opened in the step where the pumping plunger advances towards the chamber C, and is closed in the step where the pumping plunger moves away from the chamber C. During its movement of advance towards the chamber C, the pumping plunger 16 expels towards the channel 23 the air contained in the volume downstream of the solenoid valve 24, whereas during each movement of recession from the chamber C, which occurs with the solenoid valve 24 closed, the pumping plunger 16 brings about a negative pressure that causes a passage of fluid from the supplementary tank 600 into the duct d3, through the connection duct 604 and the non-return valve 700.

Consequently, after a given time interval, in which the electrical machine 53 continues to control rotation of the cam 14, the pumping plunger 16 manages to fill completely the volume of the system downstream of the solenoid valve 24 so that the supply of fuel can be enabled and the solenoid valve 24 returns to being controlled in the conventional way so as to enable opening of the intake valves 7 and ignition of the engine.

Figure 7:
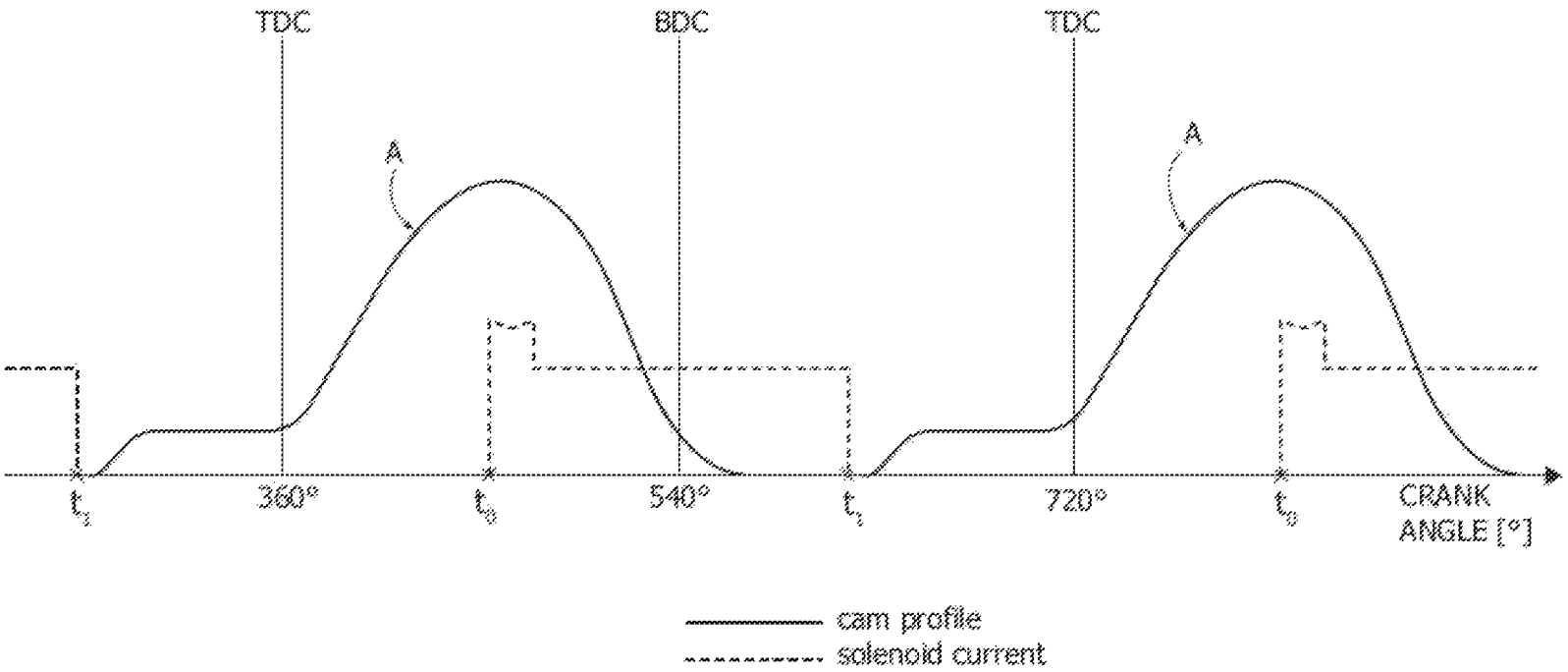
FIG. 7 illustrates a diagram similar to that of FIG. 4 that shows an operating mode of control of the electrical valve in the system according to the invention.

FIG. 7 is a schematic illustration of the mode of control of the solenoid valve 24 during the operating step described above prior to ignition of the engine, where the pumping plunger 16 is used as pump for taking in fluid from the tank 600 into the volume of fluid downstream of the solenoid valve 24, until this volume is filled. As shown in FIG. 7, closing of the solenoid valve is controlled at an instant to, when the solenoid of the solenoid valve is supplied with a peak current adapted to cause movement of the mobile member of the solenoid valve. This closing occurs substantially immediately before the pumping plunger 16 again recedes after a stroke of advance, following upon rotation of the cam 14 (the profile of lift of which is once again illustrated in FIG. 7). As is also illustrated in FIG. 7, the current signal supplied to the solenoid is then lowered to a lower non-zero (hold) value, which keeps the solenoid valve closed, up to an instant $t_1$, when the current goes back to zero and the solenoid valve consequently opens. The instant $t_1$ is immediately prior to a new stroke of advance of the pumping plunger 16 towards the pressure chamber C.

In a first embodiment, once the aforesaid operating step prior to ignition of the engine is activated, it is continued for a fixed and pre-set time interval, after which the supply of fuel is enabled and the electronic control unit 25 returns to the usual operating mode in order to cause engine ignition. This fixed and pre-set time can be established for each individual type of engine through testing. The electronic control unit can then be programmed so as to implement the aforesaid operating step prior to ignition of the engine for a fixed duration, judged in any case sufficient for guaranteeing that the volume of the system on the pressure side is totally filled with fluid and the system is again completely operative.

The same result can be obtained by programming the electronic control unit for implementing the aforesaid operating step of refilling prior to ignition of the engine for a given number of cycles of movements of advance and recession of the pumping plunger 16 associated to each cylinder.

Alternatively, it is also possible to provide a pressure sensor PS (FIG. 5) associated to the volume of the system downstream of the solenoid valve 24, the signal of which is received by the electronic control unit 25. In this case, the electronic control unit can be programmed for prolonging the aforesaid refilling operating step, prior to ignition of the engine, until the aforesaid pressure sensor PS warns that a pre-set value of the pressure in the volume of fluid downstream of the solenoid valve 24, for each cylinder of the engine, has been exceeded.

Preferably, the aforesaid operating step of refilling prior to ignition of the engine is enabled by the electronic control unit only when the need arises. For the purpose, sensor means are provided adapted to detect directly or indirectly the movement of the intake valves in such a way that the aforesaid operating step of refilling prior to ignition of the engine is activated only when, in the step of engine cranking, absence of movement of the intake valves of one or more cylinders is detected. To obtain this result it is possible to exploit, for example, a pressure sensor IMS (FIG. 6B) adapted to detect the pressure in the intake manifold IM of the engine. This sensor is usually provided in association with the fuel-injection control system. The signal issued by the pressure sensor in the intake manifold IMS is sent to the electronic control unit (for example, the unit 1000) and enables this to detect when the intake valves of one or more cylinders remain closed so as to activate accordingly the refilling operating mode prior to engine ignition.

Alternatively, it is also possible to provide an accelerometer VS (FIG. 5) associated to each intake valve 7, the signal of which is received by the electronic control unit 25 and enables immediate detection of a possible absence of movement of the intake valve.

As an alternative to the aforesaid solutions, the need to activate the refilling operating mode prior to ignition of the engine may be detected by providing a pressure sensor PS in the volume of fluid downstream of the solenoid valve 24, the signal of which is received by the electronic control unit 25 in such a way that the operating step of refilling prior to ignition of the engine can be activated when in the step of engine cranking a pressure in the aforesaid volume of fluid lower than a pre-set threshold value is detected.

Whatever the solution selected, the system is able, upon engine ignition by the driver, to determine whether it is necessary to proceed to an operating step of refilling before engine ignition. If this need is detected, the system activates the above operating mode, keeping the engine turned off and using the electrical starting machine 53 for setting each cam 14 in rotation and accordingly using the pumping plunger 16 associated to each cylinder of the engine for filling again the volume of the system downstream of the solenoid valve 24 with fluid. As has been mentioned, this is obtained in so far as the pumping plunger 16 acts as suction pump, which is able to draw in fluid from the supplementary tank 600 into the volume of the system downstream of the solenoid valve 24 until complete filling of this volume is obtained. After a pre-set time interval, or after a pre-set number of cycles of movements of advance and recession of the pumping plunger 16 associated to each cylinder, or else when a pressure sensor associated to the volume of fluid downstream of the solenoid valve 24 detects that a pre-set pressure threshold value for each cylinder of the engine has been reached, the system enables supply of the fuel and returns to the normal mode of control of the solenoid valve 24 in order to bring about ignition of the engine.

As has likewise already been mentioned, the tank 600 is pre-arranged in a condition completely isolated from the exhaust channel 23, with the outlet 603 set at a level lower than both the end of the connection duct 604 that communicates with the volume of fluid downstream of the solenoid valve 24 and the areas of the pumping plunger 16 and of the actuators 21 where there may arise leakage of fluid (differences in level H1 and H2 in FIG. 5). Consequently, it is guaranteed that the tank 600 always ensures the presence of a fluid reserve, even after prolonged inactivity of the engine.

Of course, without prejudice to the principle of the invention, the details of construction and the embodiments may vary widely with respect to what is described purely by way of example herein, without thereby departing from the scope of the claims.

What is claimed is:

1. An internal-combustion engine, comprising:

an engine shaft and at least one cylinder that defines a combustion chamber;

at least one intake duct and at least one exhaust duct, which give out into said combustion chamber;

at least one intake valve and at least one exhaust valve, which are associated to said intake and exhaust ducts and are provided with respective return springs that push the valves towards a closed position;

a camshaft for actuating said at least one intake valve by a respective tappet, said camshaft being driven in rotation by the engine shaft, wherein said at least one intake valve is controlled by the respective tappet, against action of the return spring, by interposition of an hydraulic arrangement that includes a pressure chamber facing which is a pumping plunger, connected to the tappet, said pressure chamber being adapted to communicate with a chamber of a hydraulic actuator associated to said at least one intake valve;

an electrically actuated control valve associated to said at least one intake valve of each cylinder and adapted to set in communication said pressure chamber with a discharge volume in order to decouple said at least one intake valve from the respective tappet and cause fast closing of said at least one intake valve as a result of the respective return spring;

an electronic control arrangement, for controlling said electrically actuated valve in order to vary an instant of opening and/or an instant of closing and lift of said at least one intake valve as a function of one or more operating parameters of the engine; and electrically actuated fuel-injectors, controlled by said electronic control arrangement for supplying fuel into said combustion chamber, there being associated to said engine an electrical machine for starting the engine to activate rotation of the engine shaft in a step of engine cranking, said engine being characterized in that:

said pressure chamber is in communication with an auxiliary fluid tank via a non-return valve that enables passage of fluid only from said auxiliary tank in a direction of the pressure chamber, said auxiliary tank not having any direct communication with said discharge volume; and said electronic control arrangement is programmed for activating an operating cranking step of the engine prior to ignition of the engine for the purpose of refilling the pressure chamber before the engine is started, wherein the following operations are carried out:

a) a supply of fuel to said combustion chamber is inhibited;

b) said electrical machine is activated for setting in rotation the engine shaft and consequently said camshaft so that a reciprocating motion of said pumping plunger is activated;

c) said electrically actuated control valve is cyclically opened and closed, in synchronism with movement of said pumping plunger, in such a way that said control valve is open in a step where the pumping plunger advances towards the pressure chamber and is closed in a step where the pumping plunger moves away from said pressure chamber so that the pumping plunger functions as a suction pump for recalling fluid from said auxiliary tank to the pressure chamber; and d) after a time interval, the supply of fuel to said combustion chamber is enabled and the electrically actuated control valve is kept closed to obtain actuation of the intake valves and ignition of the engine.

2. The engine according to claim 1, wherein said time interval is a pre-set time interval.

3. The engine according to claim 1, wherein said time interval corresponds to a pre-set number of cycles of forward and backward movements of the pumping plunger.

4. The engine according to claim 1, further comprising a pressure sensor adapted to detect pressure in the pressure chamber and to issue a signal that is received by said electronic control arrangement and in that said time interval corresponds to an amount of time necessary for said pressure sensor to warn that a pre-set value of the pressure in the pressure chamber has been exceeded.

5. The engine according to claim 1, wherein a sensor arrangement is provided, adapted to detect movement of said at least one intake valve and in that said electronic control arrangement is programmed for activating the operating step prior to ignition of the engine for refilling the pressure chamber when, in the step of engine cranking, absence of movement of said at least one intake valve is detected.

6. The engine according to claim 5, wherein said sensor arrangement comprises a pressure sensor for detecting pressure in an intake manifold of the engine, and is adapted to issue a signal that is received by said electronic control arrangement.

7. The engine according to claim 5, wherein said sensor arrangement comprises an accelerometer associated to said at least one intake valve, the signal of which is received by said electronic control arrangement.

8. The engine according to claim 1, wherein a pressure sensor is provided, adapted to detect pressure in the pressure chamber and to issue a signal that is received by said electronic control arrangement, and in that said electronic control arrangement is programmed for activating the operating step prior to ignition of the engine for refilling the pressure chamber when, in the step of engine cranking, a pressure in the pressure chamber lower than a pre-set threshold value is detected.

9. The engine according to claim 1, wherein said auxiliary fluid tank is connected to said pressure chamber by a connection duct having a first end that communicates with the pressure chamber on a downstream side of the control valve, opposite to a side of said discharge volume, and a second end connected to said auxiliary tank in a bottom part of said tank, and in that, in a normal condition of use of the engine, said second end is situated at a level lower than a level of said first end, and also than a level of the actuators of the intake valves and than a level of the pumping plunger, said actuators and said pumping plunger being consequently at a height greater than zero with respect to an outlet of the auxiliary tank.

10. The engine according to claim 9, wherein said auxiliary tank is also connected to a channel for supplying pressurized fluid, which communicates with said auxiliary tank in a top part of said auxiliary tank.

11. The engine according to claim 10, wherein said auxiliary tank has at least one top opening for venting into atmosphere.

12. A method for control of an internal-combustion engine, the engine comprises:

an engine shaft and at least one cylinder that defines a combustion chamber;

at least one intake duct and at least one exhaust duct, which give out into said combustion chamber;

at least one intake valve and at least one exhaust valve associated to said intake and exhaust ducts and provided with respective return springs that push the valves towards a closed position;

a camshaft for actuating said at least one intake valve by a respective tappet, said camshaft being driven in rotation by the engine shaft, wherein said at least one intake valve is controlled by the respective tappet, against action of the return spring, by interposition of an hydraulic arrangement that includes a pressure chamber facing which is a pumping plunger, connected to the tappet, said pressure chamber being adapted to communicate with a chamber of a hydraulic actuator associated to said at least one intake valve;

an electrically actuated control valve associated to said at least one intake valve of each cylinder and adapted to set in communication said pressure chamber with a discharge volume in order to decouple said at least one intake valve from the respective tappet and cause fast closing of said at least one intake valve as a result of the respective return spring;

an electronic control arrangement, for controlling said electrically actuated valve in order to vary an instant of opening and/or an instant of closing and lift of said at least one intake valve as a function of one or more operating parameters of the engine; and electrically actuated fuel-injectors, controlled by said electronic control arrangement for supplying fuel into said combustion chamber, there being associated to said engine an electrical machine for engine cranking to activate rotation of the engine shaft in a step of engine cranking, said method being characterized in that:

said pressure chamber is in communication with an auxiliary fluid tank via a non-return valve that enables passage of fluid only from said auxiliary tank in a direction of the pressure chamber, said auxiliary tank not having any direct communication with said discharge volume;

and in that an operating cranking step of the engine is activated prior to ignition of the engine for the purpose of refilling the pressure chamber before the engine is started, wherein the following operations are carried out:

a) supply of fuel to said combustion chamber is inhibited;

b) said electrical machine is activated for setting in rotation the engine shaft and consequently said camshaft so that a reciprocating motion of said pumping plunger is activated;

c) said electrically actuated control valve is cyclically opened and closed, in synchronism with movement of said pumping plunger in such a way that said control valve is open in a step where the pumping plunger advances towards the pressure chamber and is closed in a step where the pumping plunger moves away from said pressure chamber so that the pumping plunger functions as a suction pump for recalling fluid from said auxiliary tank into the pressure chamber; and d) after a time interval, the supply of fuel to said combustion chamber is enabled and the electrically actuated control valve is kept closed to obtain actuation of the intake valves and ignition of the engine.

13. The method according to claim 12, wherein said time interval is a pre-set time interval.

14. The method according to claim 12, wherein said time interval corresponds to a pre-set number of cycles of forward and backward movements of the pumping plunger.

15. The method according to claim 12, wherein the engine comprises a pressure sensor adapted to detect pressure in the pressure chamber and to issue a signal that is received by said electronic control arrangement and in that said time interval corresponds to an amount of time necessary for said pressure sensor to warn that a pre-set value of the pressure in the pressure chamber has been exceeded.

16. The method according to claim 12, wherein a sensor arrangement is provided, and is adapted to detect movement of said at least one intake valve and in that the operating step prior to ignition of the engine for refilling the pressure chamber is activated when, in the step of engine cranking, absence of movement of said at least one intake valve is detected.

17. The method according to claim 16, wherein said sensor arrangement comprises a pressure sensor for detecting pressure in an intake manifold of the engine, and is adapted to issue a signal that is received by said electronic control arrangement.

18. The method according to claim 16, wherein said sensor arrangement comprises an accelerometer associated to said at least one intake valve, the signal of which is received by said electronic control arrangement.

19. The method according to claim 12, wherein a pressure sensor is provided, adapted to detect pressure in the pressure chamber and to issue a signal that is received by said electronic control arrangement, and in that the operating step prior to ignition of the engine for refilling the pressure chamber is activated when, in the step of engine cranking, a pressure in the pressure chamber lower than a pre-set threshold value is detected.

* * * * *